US006328441B1

(12) United States Patent
Maertin

(10) Patent No.: US 6,328,441 B1
(45) Date of Patent: Dec. 11, 2001

(54) DEVICE FOR GUIDING MOVING LETTERS AND PARCELS

(75) Inventor: Uwe Maertin, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/101,714

(22) PCT Filed: Dec. 20, 1996

(86) PCT No.: PCT/EP96/05761

§ 371 Date: Jul. 16, 1998

§ 102(e) Date: Jul. 16, 1998

(87) PCT Pub. No.: WO97/26138

PCT Pub. Date: Jul. 24, 1997

(30) Foreign Application Priority Data

Jan. 16, 1996 (DE) ..... 196 01 256

(51) Int. Cl.[7] ..... B41J 2/01

(52) U.S. Cl. ..... 347/104; 271/272

(58) Field of Search ..... 347/104, 103, 347/101, 85, 6, 7, 21, 74, 54, 102; 400/642, 612, 635; 271/3.14, 3.2, 3.21, 4.04, 7, 12, 272

(56) References Cited

U.S. PATENT DOCUMENTS

| | | | | |
|---|---|---|---|---|
| 4,417,259 | | 11/1983 | Maeda . | |
| 4,523,754 | * | 6/1985 | Hisajima et al. | 271/264 |
| 5,183,251 | * | 2/1993 | Sardella | 271/276 |
| 5,522,693 | * | 6/1996 | Scheucher et al. | 414/793.1 |
| 5,528,271 | | 6/1996 | Ebisawa . | |
| 5,531,432 | * | 7/1996 | Sardella | 271/10.01 |
| 5,589,866 | * | 12/1996 | Russell et al. | 347/102 |
| 5,722,651 | * | 3/1998 | Pankhania | 271/3.19 |
| 5,808,646 | * | 9/1998 | Kitahara et al. | 347/104 |
| 5,980,034 | * | 11/1999 | Tsai et al. | 347/89 |
| 6,010,128 | * | 1/2000 | Loser et al. | 271/276 |
| 6,079,814 | * | 6/2000 | Lean et al. | 347/55 |
| 6,082,728 | * | 7/2000 | Ubayashi | 271/108 |
| 6,095,639 | * | 8/2000 | Uetsuki et al. | 347/65 |

FOREIGN PATENT DOCUMENTS

| | | |
|---|---|---|
| 0604029A2 | 6/1994 | (EP) . |
| 2272401A | 5/1994 | (GB) . |
| 96/35584 | 11/1996 | (WO) . |

* cited by examiner

*Primary Examiner*—John S. Hilten
*Assistant Examiner*—Darius N. Cone
(74) *Attorney, Agent, or Firm*—Venable; Norman N. Kunitz

(57) ABSTRACT

A device for guiding moving articles (10) past at least one ink-jet printing head (3), comprising a conveying belt and a cover belt (2, 4), as well as a guide frame (1) to prevent the depositing of ink drops in the region surrounding the printing heads (3) as a result of air turbulence developing on the edges. The printing heads (3) are located in cutouts in the guide frame (1). In accordance with the invention, flow channels (6) that extend in the article conveying direction are provided at least in the region surrounding the printing heads (3) in the guide frame (1), which flow channels are deep enough so that the flow does not stop. Narrow ridges are positioned between the flow channels (6) and are designed to guide the articles. Narrow guide elements (7) for extending the ridges are located above the ink-jet printing heads (3), in locations where the printing jets (5) are not covered. The ridges and guide elements (7), positioned in article conveying direction after the respective printing head (3), have a lower height (FIG. 1) than those in front to prevent a contact with the printed-on article sections.

6 Claims, 4 Drawing Sheets

DEVICE FOR GUIDING MOVING LETTERS AND PARCELS

BACKGROUND OF THE INVENTION

The invention refers to a device for guiding moving articles past at least one ink-jet printing head,.

As compared to mechanical printers, the use of ink-jet printers for canceling stamps has the advantage that the stamp layout can be designed freely and that it is possible to achieve a high printing quality. The layout can vary from article to article. The wear and tear is lower for these systems. In addition, advertising logos can be printed on in this way, which change from article to article.

The articles must be guided precisely while moving past the ink-jet printers. This is achieved with the aid of guide frames. Prevailing guide frames (see FIG. 3) consist of a level surface, along which the articles 10 are guided. This guidance is intended to ensure the necessary distance between article 10 and ink-jet printing head 3. The guide frame is provided with cutouts for the ink-jet printing heads 3, in which the printing heads are positioned.

Guiding the articles with these guide frames has the following disadvantages: The ink used for the printing is an oil-based ink. This ink does not dry through evaporation of a chemical substance, but is soaked up by the material used for the article. The absorption of the ink depends on the material to be printed on. If the surface is very smooth, less ink is absorbed than with a rough surface. This can even lead to very fine ink droplets spraying back, which then settle in the region surrounding the printer. The speed of these drops is clearly lower than the speed of the drops coming directly from the printing head (approximately v=11 m/s). The drops with the lower mass and the low speed can be easily influenced by an air flow.

Owing to its inherent speed, each article generates an air flow directly above its surface. Turbulences form as a result of the sharp-edged transition from the guide frame to the printing head. These turbulences cause the fine drops spraying back to be deposited on the jet backing plate for the printing head. With a continued printing operation, the fine ink drops combine to form large-surface drops, which can clog the jets of the printing head.

In order to prevent these deposits and as shown in FIG. 4, it is known to direct a forced flow 8 onto the jet backing plate. This causes a "blowing clean" of the jet backing plate or prevents a settling down of fine drops in the jet region. The air flow is guided through fine flow ducts from the back toward the jet backing plate (see FIG. 4). The disadvantage here is that a blower must additionally be installed to generate the flow. Owing to the short distances, a considerable design and production-technology expenditure is necessary to direct the flow toward the guide frame.

Another problem is created by articles coming in contact with the printing heads. The articles are not stiff or flat, as would be ideal. Owing to the short distance between article and printing head, the articles frequently come in contact with the jet backing plate, which leads to an increased amount of ink released by the jets. Owing to the high throughput, it is not possible to supply enough ink to the jets and air enters the jets. This leads to a decrease in the printing intensity up to the complete failure of the jets.

It is therefore the object of the invention, to create a device for guiding moving articles past ink-jet printers, which device prevents, with low expenditure a rapid clogging of the printing jets as a result of deposited ink droplets.

SUMMARY OF THE INVENTION

The above object is solved in accordance with the present invention by devices for guiding moving articles past at least one ink-jet printing head, preferably in an article distribution systems, which comprises a conveying belt and a cover belt, as well as a guide frame for guiding the articles disposed between the two belts at a defined distance past the ink-jet printing heads, with the ink-jet printing head or the ink-jet printing heads being respectively located in a cutout in the guide frame and with the speed of the article being high enough, so that air turbulence develops at the edges of the cutout. Flow channels that extend in the article-conveying direction are provided at least in the region surrounding the ink-jet printing head or heads in the guide frame, with the flow channels being deep enough so that the flow does not stop. Narrow ridges for guiding the articles are positioned between the flow channels and the ridges and any narrow guide elements which are positioned after the printing jets of the respective ink-jet printing head in the transporting direction of the articles, and which are designed to prevent contact with the printed-on section of the articles, have a lower height as compared to those located in front of the printing heads. The advantage here is that it is not necessary to have a forced flow, generated at high expenditure with a blower, but that the air flow generated by the fast moving articles is used to transport the spraying-back drops to the area behind the printing heads. This air flow can form only in the flow channels. The ridges for maintaining the necessary distance between article and ink-jet printing head in this case do not have an essentially negative effect on transporting off the ink drops. The expedient guide elements, which are arranged above the ink-jet printing heads for a better maintaining of the distance, can be fastened either to the ridges on the guide frame or to the ink-jet printing heads themselves.

The invention is explained in further detail with one example and with the aid of the drawings.

DETAILED DESCRIPTION OF THE PREFERRED EMBODIMENTS

Figure 1:
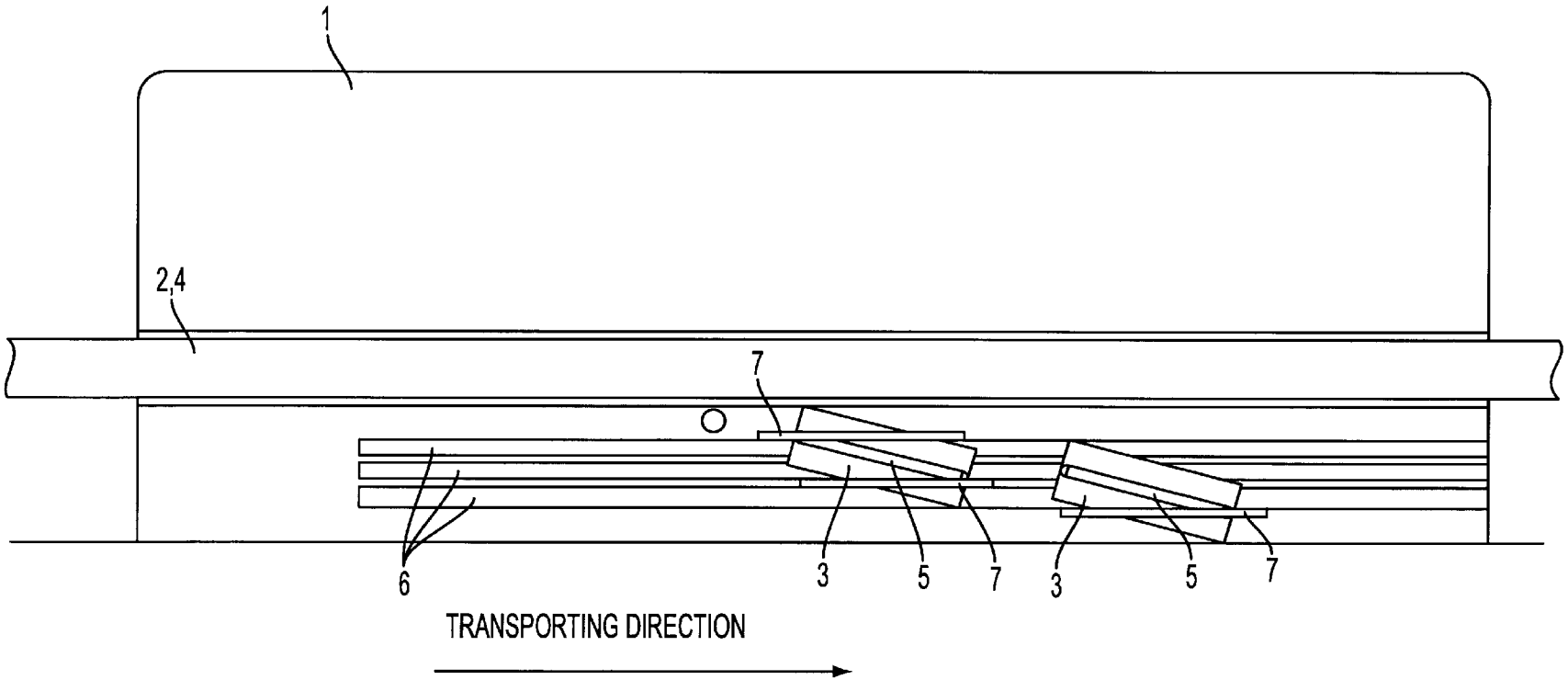
FIG. 1 is a schematic frontal view of the device according to the invention.

In accordance with FIG. 1, the articles 10, which are wedged in between the conveying belt 4 and the cover belt 2, are conveyed in the specified direction past two ink-jet printing heads 3 with a speed of approximately 3 m/s. A light barrier 9 signals that the article 10 has reached the ink-jet printing heads 3. Each ink-jet printing head 3 comprises 32 side-by-side arranged rows of jets with 3 jets each, with which respectively 1 line can be printed. As follows from FIG. 1, flow channels 6 are installed in the guide frame 1, in the vicinity of the ink-jet printing heads 3 that are located in the cutouts, which flow channels are approximately 1–1.5 mm deep and extend in the conveying direction for the articles. This depth is sufficient, so that the air flow at the guide frame 1, generated by the articles 10, does not stop and the drops are transported to the area behind the printing heads 3. Narrow ridges are installed between the flow channels 6 to guide the articles 10 and to maintain the required distance between the articles 10 and the ink-jet printing head 3 (approximately 0.5 mm). Above the ink-jet printing heads 3, these ridges are bridged by means of narrow guide elements 7, which are either fastened with clamping connections to the ridges, or which are connected to the ink-jet printing heads. The guide elements 7 in this case are fastened only where they do not cover the printing jets 5 and where they do not smudge the fresh prints.

Figure 2:
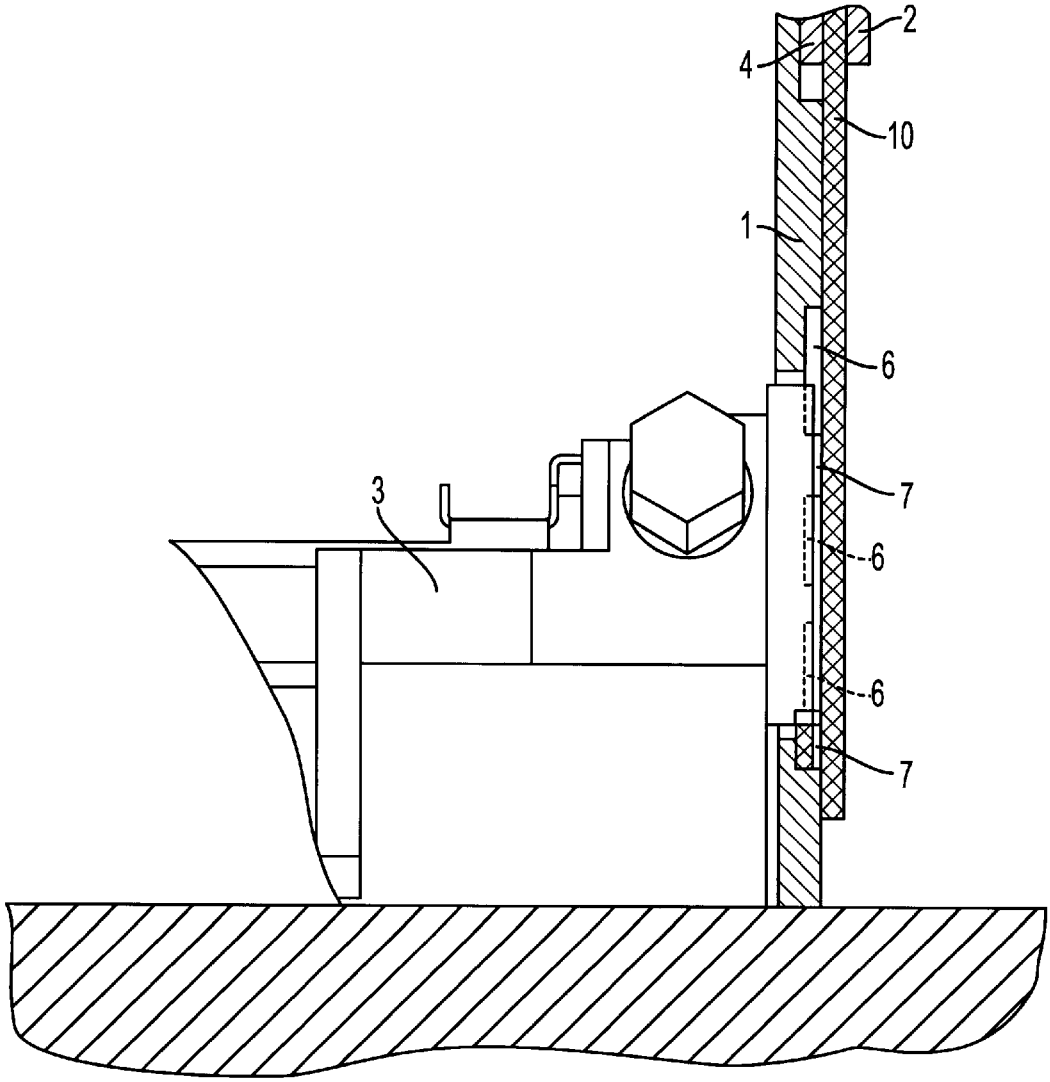
FIG. 2 is a view from the side of the device according to the invention.
Figure 3:
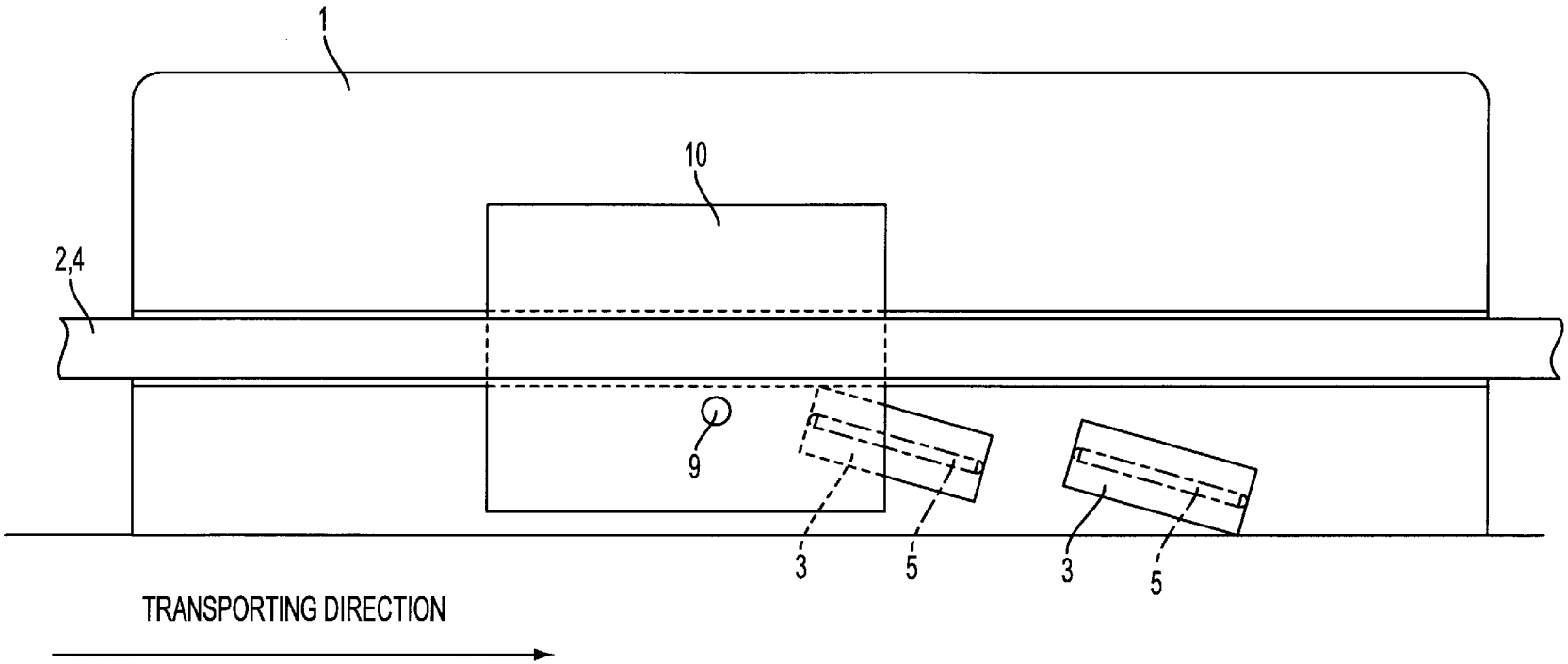
FIG. 3 is a frontal view of a traditional device with a level guide frame.
Figure 4:
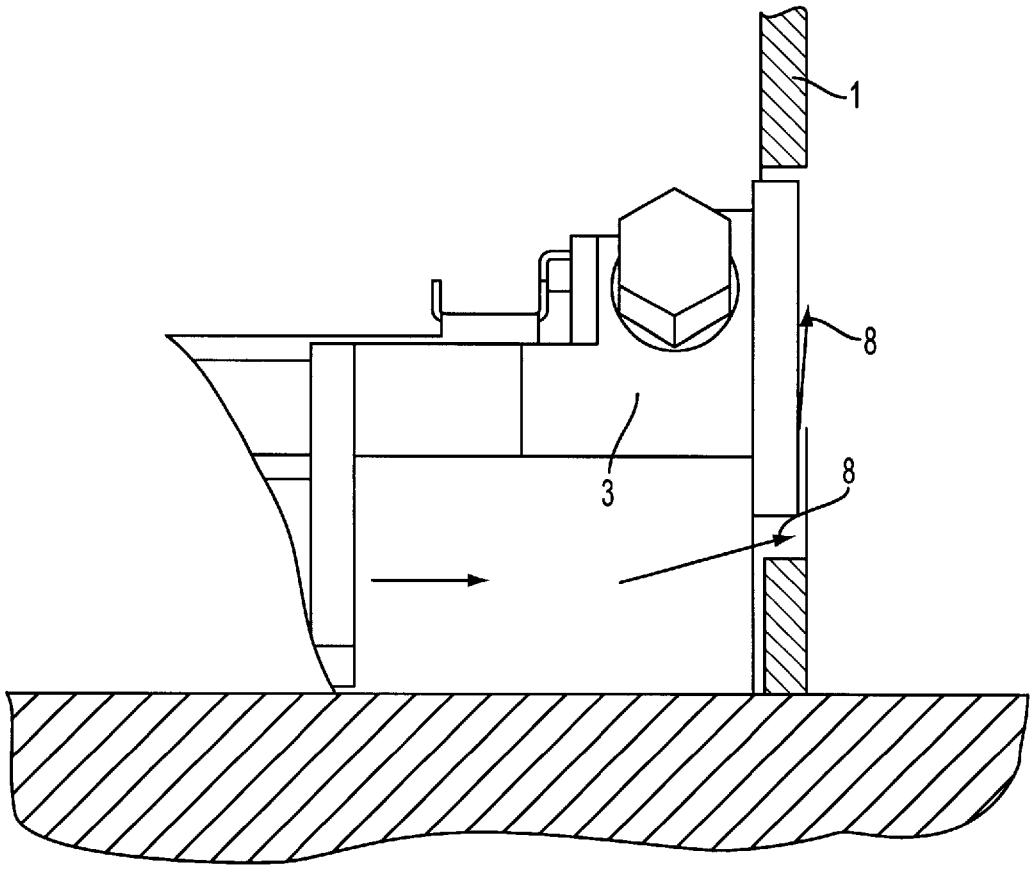
FIG. 4 is a view from the side of a device with level guide frame and forced ventilation.

The ridges behind the printing jets 5 of the ink-jet printing heads 3 are shorter than the ridges in front, also to prevent a smudging of the fresh print. The height profile of the guide frame 1 is easily visible in the side view according to FIG. 2.

What is claimed is:

1. A device for guiding moving articles past at least one ink-jet printing head, preferably in article distribution systems, comprising a conveying belt and a cover belt, as well as a guide frame for guiding the articles disposed between the conveying and cover belts at a defined distance past the ink-jet printing heads, and wherein: the ink-jet printing head or the ink-jet printing heads are respectively located in a cutout in the guide frame; the speed of the articles is high enough, so that air turbulence develops at the edges of the cutout:

air flow channels (6) that extend in an article-conveying direction are provided, at least in the region surrounding the ink-jet printing head or heads (3), in the guide frame (1), which flow channels are deep enough so that the air flow does not stop; narrow ridges for guiding the articles are positioned between the flow channels (6); and the ridges, and any narrow guide elements (7), positioned after the printing jets of the respective ink-jet printing head (3) in a transporting direction of the articles (10), and which are designed to prevent contact with the printed-on section of the articles, have a lower height as compared to those located in front of the printing jets.

2. A device according to claim 1, wherein the narrow guide elements (7) are located above the ink-jet printing heads (3) as a means for the extending the ridges for guide frame (1), but only in locations where the printing jets (5) are not covered.

3. A device according to claim 2, wherein the guide elements (7) above the ink-jet printing heads (3) are fastened to the ridges for the guide frame (1).

4. A device according to claim 2, wherein the guide elements (7) above the ink-jet printing heads (3) are fastened to the ink-jet printing heads.

5. Device for guiding moving articles past at least one ink-jet printing head in an article distribution system, comprising: a conveying belt and a cover belt; a guide frame having a surface for guiding articles disposed between the conveying and cover belts at a defined distance past at least one ink-jet printing head located in a cutout in the surface of the guide frame, with the speed of the articles being sufficiently high that air turbulence develops at the edges of the cutout; a plurality of air flow channels that extend in an article-conveying direction provided in the surface of the guide frame at least in a region surrounding the at least one ink-jet printing head, with the flow channels being sufficiently deep that the air flow does not stop; and a plurality of narrow ridges for guiding the articles positioned between the flow channels, with the ridges, and any narrow guide elements positioned after the at least one ink jet printing head in a transporting direction of the articles to prevent contact with the printed section of the articles, having a lower height as compared to those located in front of the printing head.

6. A device for guiding moving articles past at least one ink-jet printing head in an article distribution system, comprising: a guide frame having a surface with a cutout therein and at least one ink-jet printing head located in the cutout; an article conveying system including a conveying belt and a cover belt mounted on the guide frame such that said surface of the guide frame guides articles disposed between the conveying and cover belts at a defined distance past the at least one ink jet printing head in the cutout in the surface of the guide frame, with the speed of the articles being sufficiently high that air turbulence develops at the edges of the cutout; a plurality of air flow channels that extend in an article-conveying direction provided in the surface of the guide frame at least in a region surrounding the at least one ink-jet printing head, with the flow channels being sufficiently deep that the air flow does not stop; and a plurality of narrow ridges positioned on the surface between the flow channels for guiding the articles; with the height of the ridges, and any narrow guide elements positioned to prevent contact with the printed section of the articles, disposed after the at least one ink jet printing head in a transporting direction of the articles, being lower than the ridges and any guide elements located before the printing head.

* * * * *